US007775176B2

(12) United States Patent
Abel

(10) Patent No.: US 7,775,176 B2
(45) Date of Patent: Aug. 17, 2010

(54) DEVICE FOR ADJUSTABLY SUSPENDING A BOAT FENDER FROM A ROD HOLDER

(75) Inventor: Neal Abel, Jacksonville, FL (US)

(73) Assignees: Reagan Abel, Jacksonville, FL (US); Alexandra Abel, Jacksonville, FL (US)

( * ) Notice: Subject to any disclaimer, the term of this patent is extended or adjusted under 35 U.S.C. 154(b) by 19 days.

(21) Appl. No.: 11/773,307

(22) Filed: Jul. 3, 2007

(65) Prior Publication Data

US 2008/0006195 A1 Jan. 10, 2008

Related U.S. Application Data

(60) Provisional application No. 60/806,557, filed on Jul. 5, 2006.

(51) Int. Cl.
*B63B 17/00* (2006.01)

(52) U.S. Cl. ..... 114/364

(58) Field of Classification Search ..... 114/364; 24/115 R, 127

See application file for complete search history.

(56) References Cited

U.S. PATENT DOCUMENTS

| | | | | |
|---|---|---|---|---|
| 3,699,950 | A * | 10/1972 | Humphrey et al. | 600/249 |
| 5,241,774 | A * | 9/1993 | Rayburn | 43/44.9 |
| 7,302,900 | B1 * | 12/2007 | Stefano | 114/218 |
| 2004/0237164 | A1 * | 12/2004 | Aperfine et al. | 2/69 |
| 2006/0245179 | A1 * | 11/2006 | Halasz et al. | 362/157 |
| 2007/0266616 | A1 * | 11/2007 | Rienzo | 43/21.2 |

* cited by examiner

*Primary Examiner*—Stephen Avila
(74) *Attorney, Agent, or Firm*—Mark Young, P.A.

(57) ABSTRACT

A boat fender system is configured for suspending a boat fender from a conventional rod holder. The system includes a handle configured for engagement by a rod holder. A boat fender is coupled to the handle by a tether. The tether has a length to allow the fender to hang from the handle to a desired location. The length may be fixed or adjustable. A compartment in the handle stores excess and unused portions of the tether.

5 Claims, 5 Drawing Sheets

DEVICE FOR ADJUSTABLY SUSPENDING A BOAT FENDER FROM A ROD HOLDER

RELATED APPLICATION

This application claims the benefit of priority of U.S. provisional application 60/806,557, filed Jul. 5, 2006, the entire contents of which are incorporated herein by this reference.

FIELD OF THE INVENTION

This invention relates to boat fenders, and more particularly, to an adjustable boat fender suspender configured for engagement by a conventional rod holder.

BACKGROUND

Fenders are widely used to protect boat hulls from physical damage by providing a durable cushion between the hull and another structure, such as a dock. Conventional fenders are typically comprised of an elongated body coupled to a tether. The body is typically a cylindrical structure comprised of an inflatable cushioning bladder, a closed cell foam cushion, a high density foam cushion, a combination of any of the foregoing, or some other form of shock absorbing structure. Typically an eyelet is formed at an end of the body for attaching it to one end of a tether, such as a nylon mooring line. In use, the other end of the tether is generally secured to a cleat mount or rail of a boat and the fender is suspended alongside areas of the hull likely to otherwise come in contact with a dock. When a fender is not in use, it is typically removed from the rail or cleat stored away in a locker or on a rack.

The tasks of tying, untying, and adjusting the length of rope is tedious and conducive to error. If a fender is suspended either too high or too low it may not protect the hull. If the rope is too long, the excess rope may lay onto the deck, presenting a tripping hazard. Even when boat fenders are removed for storage in lockers, or fender racks, the rope used for attaching the fenders to the rail or cleat may be difficult to gather and neatly store without tangling.

The invention is directed to overcoming one or more of the problems and solving one or more of the needs as set forth above.

SUMMARY OF THE INVENTION

To solve one or more of the problems set forth above, in an exemplary implementation of the invention, a boat fender system is provided. The system is configured for suspending a boat fender from a conventional rod holder. The system includes a handle configured for engagement by a rod holder. A boat fender is coupled to the handle by a tether. The tether has a length sufficient to allow the fender to hang from the handle to a desired location. The length may be fixed or adjustable. A compartment in the handle stores excess and unused portions of the tether.

In an exemplary embodiment, a boat fender suspender according to principles of the invention is configured for engagement by a conventional rod holder on a boat. The suspender includes a handle configured for engagement by a rod holder. A tether has a proximal end attached to the handle and distal end adapted for attachment to a boat fender. The tether has a length to allow the fender to hang from the handle to a desired location alongside a boat. The tether may be an adjustable length tether, meaning various lengths of the tether can be extended from the handle. The elongated hollow tubular handle body may be buoyant. A boat fender may be rotatably attached to the distal end of the tether.

The handle may include an elongated hollow tubular handle body. A compartment within the hollow tubular handle body contains the tether. The tether may be coiled within the compartment for storage. A first end cap may seal the proximal end of the handle body. A second cap with a central aperture may seal the distal end of handle body. Optionally, a third cap with an ecentric aperture is threadedly engaged by the second cap and the tether passes through the eccenbtric aperture and the central aperture.

In another embodiment, the second cap includes a slot and contains a spring clip. The spring clip has a pair of arms extending through the slot. The spring clip also has a coil with a contracted diameter less than a diameter of the tether.

In yet another embodiment, a ferrule is disposed between the handle body and the second cap. The ferrule is configured to be compressed by the second cap. The tether passes through the ferrule and the second aperture.

In another embodiment, the hollow tubular handle body includes an additive, such as a photochromic additive in an amount effective to cause a visible change in color when the hollow tubular handle body reaches a predetermined temperature. As an alternative, the hollow tubular handle body may include a thermochromic additive in an amount effective to cause a visible change in color when the hollow tubular handle body reaches a determined temperature. As another alternative, the hollow tubular handle body includes a phosphorescent additive in an amount effective to absorb light energy and continue to release that energy as visible light in darkened conditions.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the types of fenders, shapes, relative sizes, ornamental aspects or proportions of components shown in the figures.

DETAILED DESCRIPTION

Figure 2:
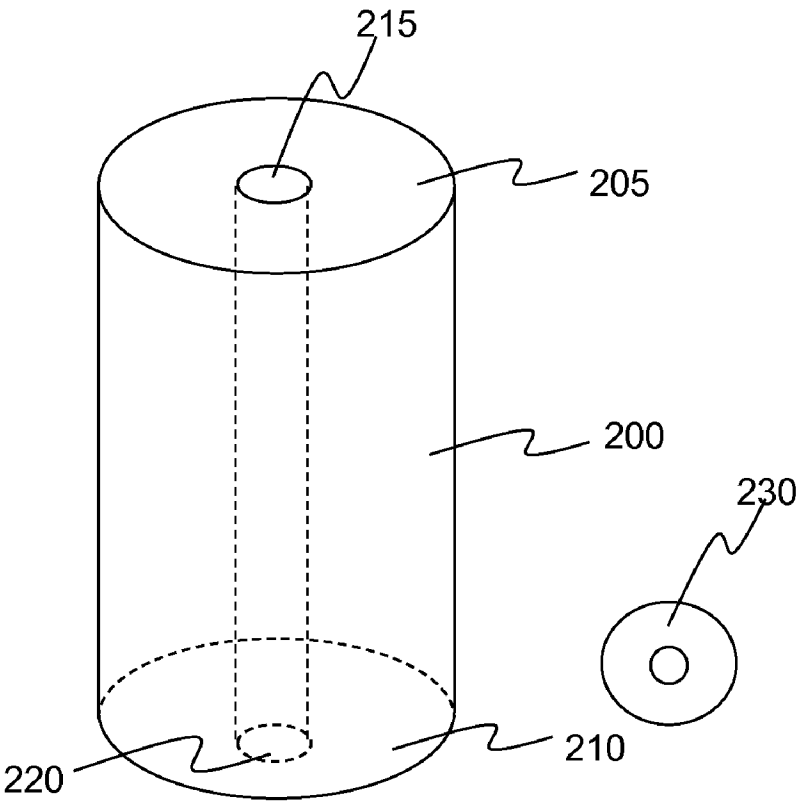
FIG. 2 provides a perspective view of another exemplary fender and washer suitable for suspension from a rod holder with an adjustable length rope in accordance with principles of the invention.

This invention relates to boat fenders, and more particularly, to a boat fender with and adjustable length rope and configured for suspending from conventional rod holders. For illustrative purposes the detail description that follows focuses primarily on an exemplary embodiment of the invention configured for suspending a fender as illustrated in FIG. 2. However, the invention is not limited to event any particular fender, so long as the fender may be suspended from a tether. Instead, the principles of the invention may be applied to the fender illustrated in FIG. 1, and to any other fender now known or hereafter developed that may be suspended alongside a vessel. The scope of the invention herein encompasses all such usages.

Figure 1:
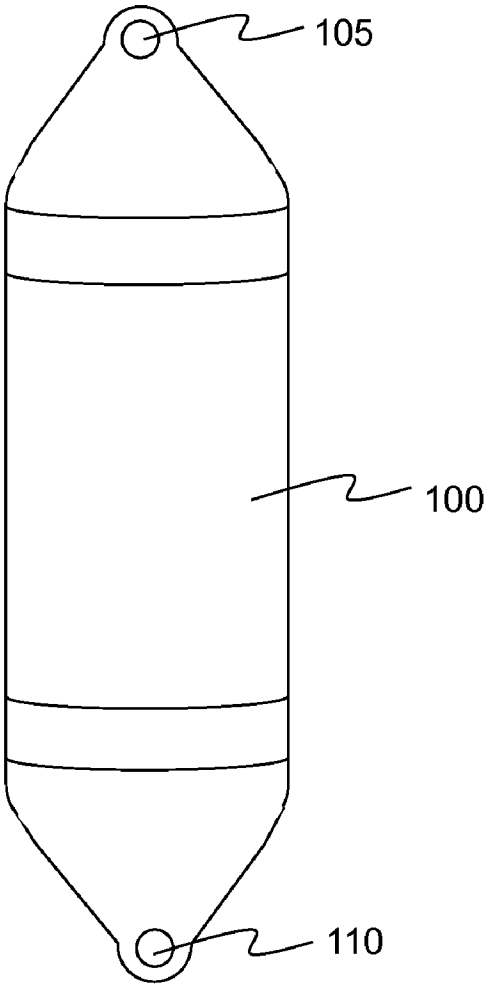
FIG. 1 provides a plan view of an exemplary fender suitable for suspension from a rod holder with an adjustable length rope in accordance with the principles of the invention.

Referring now to FIG. 1, a plan view of an exemplary fender suitable for suspension from a rod holder with an adjustable length rope in accordance with the principles of the invention is shown. The exemplary fender includes a cylindrical body 100 comprised of an inflatable cushioning bladder, a closed cell foam cushion, a high density foam cushion, a combination of any of the foregoing, or some other form of shock absorbing structure. Eyelets 105, 110 are formed at the top and bottom ends of the body 100, respectively, for attaching it to a tether, such as a nylon mooring line. However, the principles of the invention do not require any eyelets. Other means for attaching a tether to a fender may be applied within the scope of the invention.

Referring now to FIG. 2, a perspective view of another exemplary fender and washer suitable for suspension from a rod holder with an adjustable length rope in accordance with principles of the invention is shown. The exemplary fender includes a cylindrical body 200 comprised of an inflatable cushioning bladder, a closed cell foam cushion, a high density foam cushion, a combination of any of the foregoing, or some other form of shock absorbing structure. A concentric channel extends from a top aperture 215 at the top end 205 of the fender to a bottom aperture 220 at the bottom end 210 of the fender. A free end of a tether, such as a nylon mooring line, may be passed through the channel 215-220 and a washer 230 at the bottom end 210. The outer diameter of the washer is greater than the diameter of the bottom aperture, so that the washer cannot pass through the bottom aperture. The diameter of the aperture of the washer 230 is less than the diameter of the bottom aperture 220 and slightly larger than the diameter of the tether. The free end of the tether passing through the washer 230 may be knotted to prevent withdrawal through the washer 230 and channel 215-220.

While, the principles of the invention do not require a fender with a central channel as conceptually illustrated in FIG. 2, such a fender provides an important advantage. The central channel facilitates rolling motion (i.e., rotation of the fender about the axis concentric with the aperture) due to shear forces encountered during docking. Such rolling motion reduces the risks of abrasive damage to the hull and excessive twisting of the tether.

Figure 4:
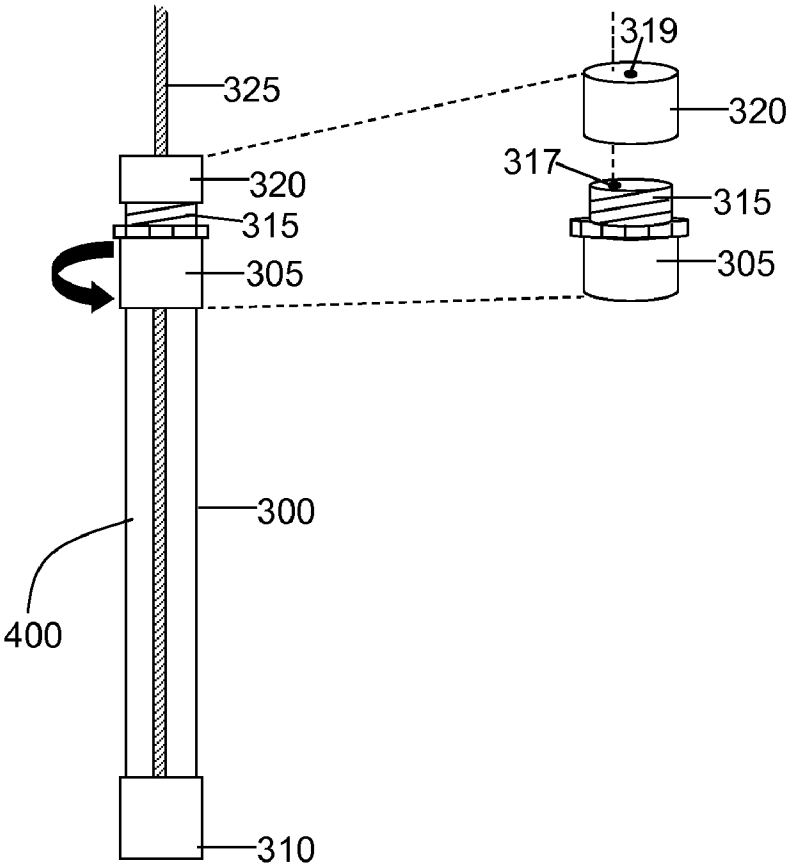
FIG. 4 conceptually illustrates an exemplary adjustable handle with an adjustable length rope for suspending a boat fender from a rod holder in accordance with principles of the invention.
Figure 3:
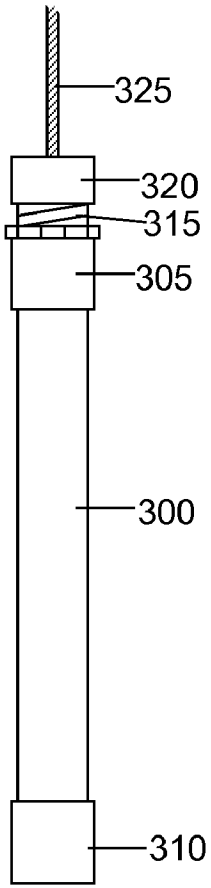
FIG. 3 conceptually illustrates an exemplary adjustable handle with an adjustable length rope for suspending a boat fender from a rod holder in accordance with principles of the invention.

Referring now to FIGS. 3 and 4, an exemplary adjustable handle for a boat fender in accordance with principles of the invention is shown. The handle includes an elongated hollow tubular handle body 300. A compartment 400 within the handle body 300 is configured for containing excess and stored portions of rope (or other tether). Rope may be coiled within the compartment for neat compact storage without entanglement. A first end cap 310 seals the proximal end of the body 300. A male threaded cap 305 with an eccentric aperture 317 is provided at the distal end of handle body 300. A corresponding female threaded cap 320 with a concentric aperture 319 is also provided. The eccentric aperture 317 and the concentric aperture 319 each have a diameter that is slightly larger than the diameter of the rope 325. When the female threaded cap 320 is secured to the male threaded cap 305, the rope passing through the concentric aperture 319 and the eccentric aperture 317 becomes securely sandwiched between the female threaded cap and the male threaded cap 305. When the female threaded cap 320 is loosened from the male threaded cap 305, the rope passing through the concentric aperture 319 and the eccentric aperture 317 is released between the female threaded cap and the male threaded cap 305 and free to withdraw. The handle body 300 features a size and contour that comfortably and securely fits in a fishing pole holder.

Figure 5:
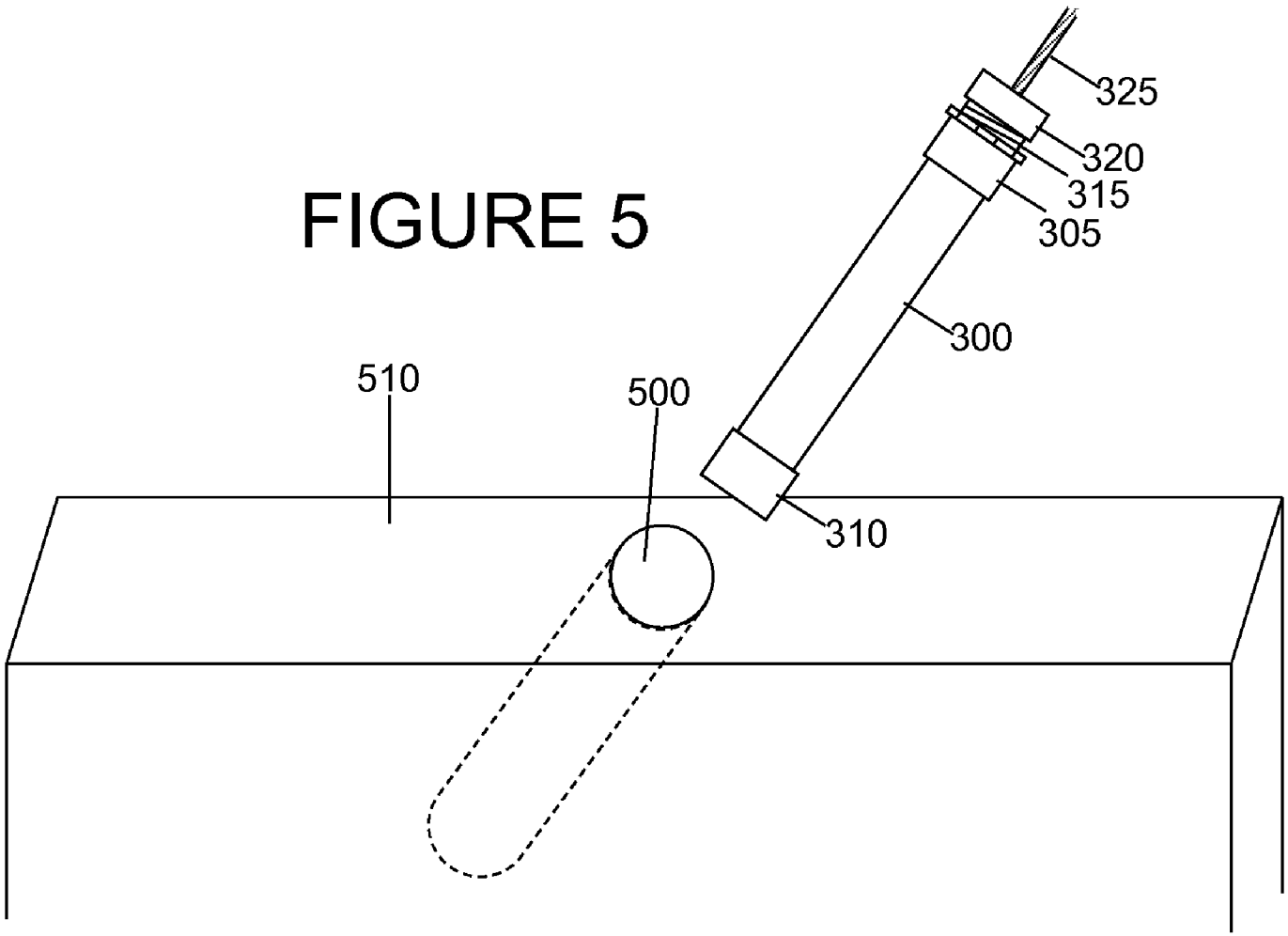
FIG. 5 conceptually illustrates an exemplary adjustable handle and a rod holder for a boat fender suspended from a rod holder and having an adjustable length rope in accordance with principles of the invention.

Referring now to FIG. 5, an exemplary adjustable handle and a rod holder in accordance with principles of the invention are shown. Fishing boats are often equipped with rod holders 500 along their port and starboard gunnels and across the transom top board 510 to thereby enable fishermen to use more than one fishing rod. The rod holders may be built into the structure, surface mounted, or attached using additional hardware. The handle body 300 of the exemplary fender holder is configured to be received by conventional rod holders 500. As the handle 300 may readily be inserted into and removed from a rod holder 500, the fender holder is easy to install and remove for storage. Additionally, being designed to support substantial loads, a rod holder has the physical integrity to adequately support a fender during normal usage conditions. Moreover, use of the rod holders allows the cleats to be used for other purposes such as mooring lines for securing a vessel to a dock.

Figure 6:
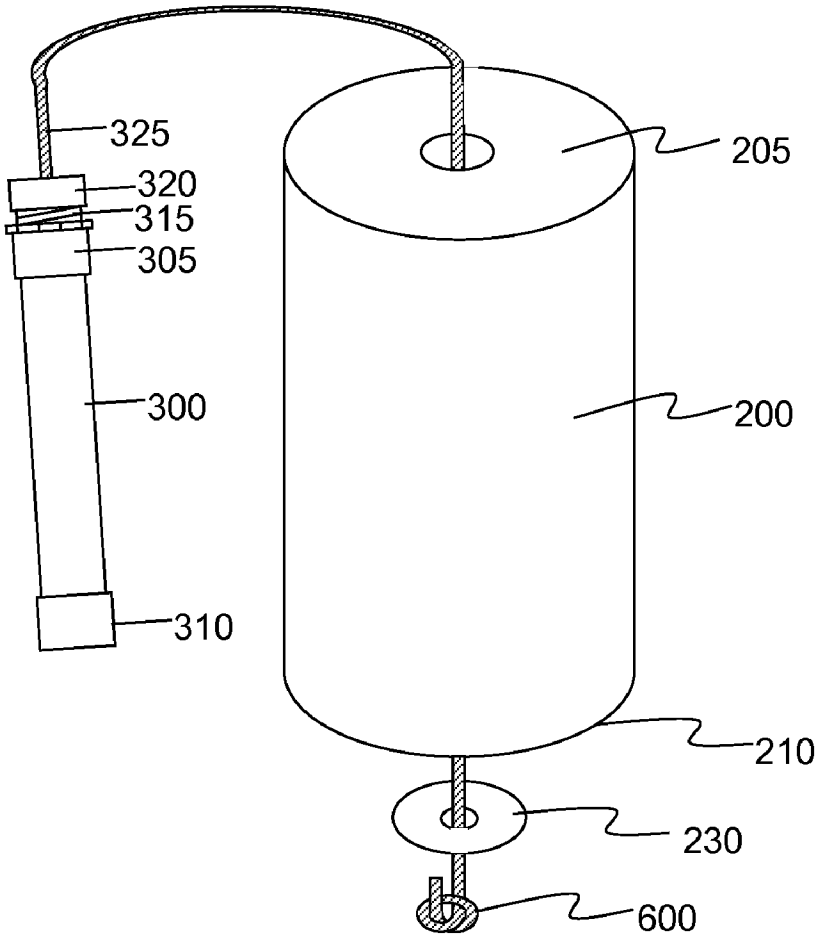
FIG. 6 conceptually illustrates an exemplary adjustable handle and a boat fender suspended from the handle and having an adjustable length rope in accordance with principles of the invention.

Referring now to FIG. 6, an exemplary adjustable handle and a boat fender suspended from the handle and having an adjustable length rope in accordance with principles of the invention is shown. The handle includes an elongated hollow tubular handle body 300. A compartment 400 (shown in FIG. 4) within the handle body 300 is configured for containing excess and stored portions of rope (or other tether). Rope may be coiled within the compartment for neat compact storage without entanglement. A first end cap 310 seals the proximal end of the body 300. A male threaded cap 305 with an eccentric aperture 317 is provided at the distal end of handle body 300. A corresponding female threaded cap 320 with a concentric aperture 319 is also provided. The eccentric aperture 317 and the concentric aperture 319 each have a diameter that is slightly larger than the diameter of the rope 325. When the female threaded cap 320 is secured to the male threaded cap 305, the rope passing through the concentric aperture 319 and the eccentric aperture 317 becomes securely sandwiched between the female threaded cap and the male threaded cap 305. When the female threaded cap 320 is loosened from the male threaded cap 305, the rope 325 passing through the concentric aperture 319 and the eccentric aperture 317 is released between the female threaded cap and the male threaded cap 305 and free to withdraw. The exemplary fender includes a cylindrical body 200 comprised of an inflatable cushioning bladder, a closed cell foam cushion, a high density foam cushion, a combination of any of the foregoing, or some other form of shock absorbing structure. A concentric channel extends from a top aperture 215 at the top end 205 of the fender to a bottom aperture 220 at the bottom end 210 of the fender. A free end of the rope 325 is passed through the channel 215-220 and through an aperture of a washer 230 at the bottom end 210. The outer diameter of the washer 230 is greater than the diameter of the bottom aperture 215-220, so that the washer 230 cannot pass through the bottom aperture. The diameter of the aperture of the washer 230 is less than the diameter of the bottom aperture 220 and slightly larger than the diameter of the tether. The free end of the rope passing through the washer 230 may be knotted 600 to prevent withdrawal through the washer 230 and channel 215-220. Thus, the weight of the fender rests upon the washer 230.

To accommodate a long length of rope 325, the handle body 300 may contain a shaft or spool 705 and means for rotation, such as a manually rotatable cap 3 10. The rope 325 may be wound around the shaft 705 by rotating the cap 310 in a first direction. The rope 325 may be unwound and withdrawn from the handle body 300 by pulling it and/or rotating the end cap 310 in a direction opposite the first direction.

The handle body 300 may be comprised of various materials, such as metal and/or plastic. In an exemplary implementation, the handle body 300 is comprised of a rigid plastic or polymeric material, such as polyvinyl chloride (PVC), polyethylene, polypropylene, polystyrene, acrylics, cellulosics, acrylonitrile-butadiene-styrene terpolymers, urethanes, thermo-plastic resins, thermo-plastic elastomers (TPE), acetal resins, polyamides, polycarbonates and polyesters. While many other materials may be used alone or in combination with the aforementioned materials and/or other materials, without departing from the scope of the present invention, preferably the material is relatively inexpensive, easy to use in manufacturing operations and results in an aesthetically acceptable, durable, weather and salt water resistant product. The material may further include additives to provide desired properties such as desired colors, structural characteristics, glow-in-the dark properties and thermal reactivity (e.g., color changes according to heat).

By way of example and not limitation, the handle body 300 may optionally be formulated to change color when it reaches a predetermined or higher temperature. This can be accomplished by mixing a thermochromic additive to the base material in an amount that is sufficient to achieve a desired color changing range. As an example, a mixture of approximately 5% to 30% (pbw) of Matsui International Co., Inc.'s Chromicolor® concentrate may be introduced to the base material, to provide a plastic structure that visibly changes color at a determined elevated temperature, such as approximately 90 degrees Fahrenheit or higher.

Alternatively, a photochromic additive may be added to the base material in an amount that is effective to achieve a desired color change when the handle body 300 is exposed to certain lighting conditions. As an example, a mixture of approximately 5% to 35% (pbw) of Matsui International Co., Inc.'s Photopia® additive may be introduced to the base material, to provide a plastic structure that visibly changes color in the presence of sunlight or ultraviolet light.

As another alternative, phosphorescent polymer additives, such as aluminate based phosphors, may be added to adsorb light energy and continue to release that energy as visible light after the energy source is removed. Advantageously, such an embodiment provides a handle body 300 that is easy to locate in darkened conditions, making the device easy to spot even at nighttime.

The handle body 300 may be produced using any suitable manufacturing techniques known in the art for the chosen material, such as (for example) injection, compression, structural foam, blow, or transfer molding; polyurethane foam processing techniques; vacuum forming; and casting. Preferably, the manufacturing technique is suitable for mass production at relatively low cost per unit, and results in an aesthetically acceptable product with a consistent acceptable quality.

The exemplary embodiments described above include one exemplary mechanism for locking the rope at a desired length. Other locking means may be utilized within the scope of the invention. For example, the line may be cut to size and either knotted so that a knotted end within the handle cannot pass through a narrow aperture in cap 320 or attached to the interior structure of the handle. Still, other means for controlling the length of rope allowed to be withdrawn from the handle 300 may be utilized within the scope and spirit of the invention. Such other means may, for example, include spools, reels and other devices with locking mechanisms.

Figure 7:
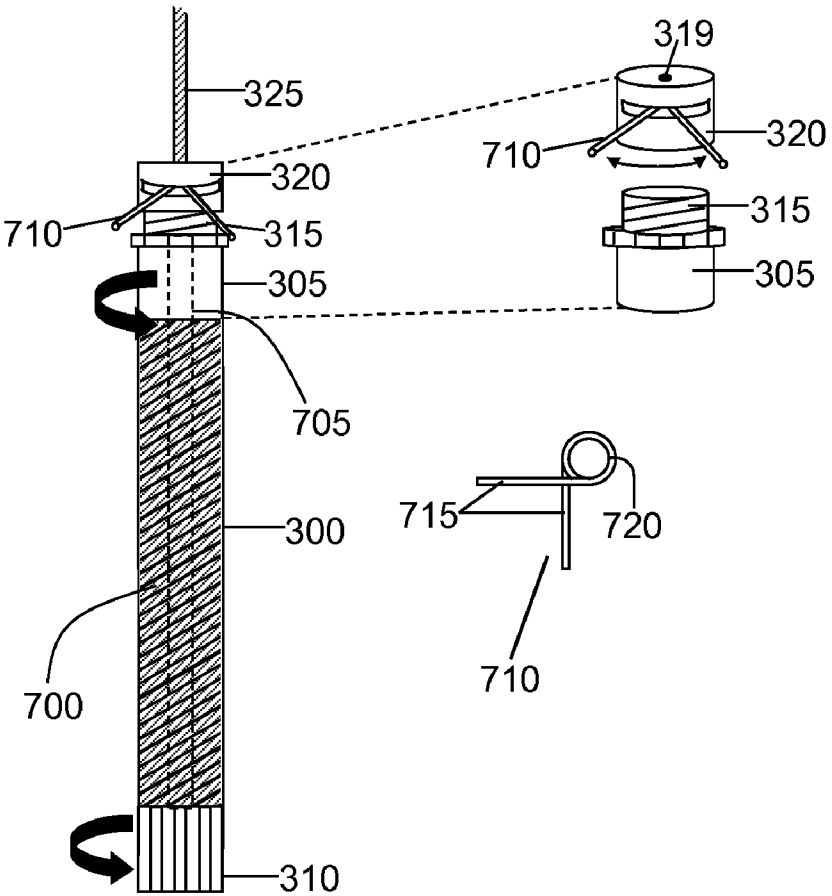
FIG. 7 conceptually illustrates an exemplary adjustable handle with an adjustable length rope and a spring clamp for suspending a boat fender from a rod holder in accordance with principles of the invention.

Illustratively, as shown in FIG. 7, a spring clamp 710 may be provided to controllably grip and lock the rope at a desired length. A slot 725 in the cap allows exposure of the arms 715 of the spring clamp 710. The diameter of the spring clamp coil 720 expands when the arms 715 are urged towards each other. When pressure is relieved from the arms 715, the arms 715 return to their original position and spring clamp coil 720 contracts. The contracted coil 720 grips the engaged portion of the rope 325.

Figures 8, 9:
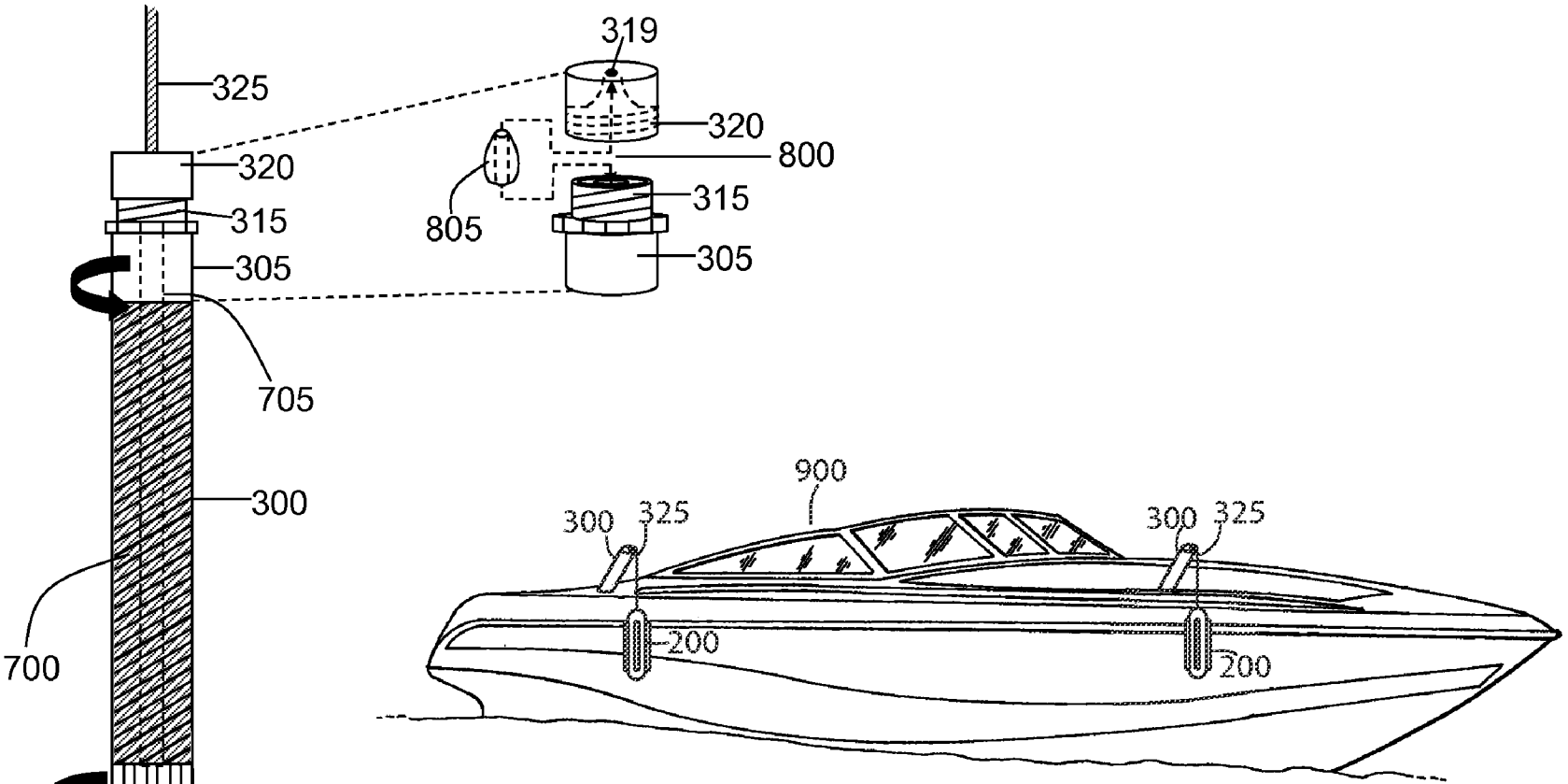
FIG. 8 conceptually illustrates an exemplary adjustable handle with an adjustable length rope and a compression fitting for suspending a boat fender from a rod holder in accordance with principles of the invention.
FIG. 9 conceptually illustrates an exemplary adjustable handle with an adjustable length rope suspending a boat fender from a rod holder of a boat in accordance with principles of the invention.

As another example, as shown in FIG. 8, a compression fitting assembly 800 may be provided to controllably grip and lock the rope 325 at a desired length. The compression fitting is composed of the cap 320 which serves as an outer "compression nut" and a ferrule 805, i.e. a gripping band or ring. The rope 325 passes through the central aperture of the ferrule. When the cap 320 is tightened, it clamps-down on the ferrule 805, compressing the ferrule 805 and causing it to tightly conform to the circumference of the rope 325.

The ferrule may vary in shape and material according to the rope material. By way of example and not limitation, the ferrule may be comprised of a rubber, plastic or polymeric material, such as silicone, polyvinyl chloride (PVC), polyethylene, polypropylene, polystyrene, acrylics, cellulosics, acrylonitrile-butadiene-styrene terpolymers, urethanes, thermoplastic resins, thermo-plastic elastomers (TPE), acetal resins, polyamides, polycarbonates, polyesters, polyisoprene, butyl rubber, halogenated butyl rubber, polybutadiene, styrene-butadiene rubber, nitrile rubber, hydrated nitrile rubber, chloroprene rubber, ethylene propylene rubber, ethylene propylene diene rubber, epichlorohydrin rubber, polyacrylic rubber, fluorosilicone rubber, fluoroelastomers, perfluoroelastomers, tetrafluoro ethylene/propylene rubbers, chlorosulfonated polyethylene, ethylene-vinyl acetate, thermoplastic elastomers and thermoplastic vulcanizates. While many other materials may be used alone or in combination with the aforementioned materials and/or other materials, without departing from the scope of the present invention, preferably the material is relatively inexpensive, easy to use in manufacturing operations and results in a durable, sea water resistant product.

Optionally, the handle body 300 includes a buoyant padding material such as Neoprene foam or other cushioning buoyant material. The buoyant padding material should have a thickness sufficient for providing general buoyancy to the device. As used herein, buoyancy refers to an upward force on the handle body 300 produced by surrounding fluid (i.e., water) in which it is fully or partially immersed. The net upward buoyancy force is equal to the magnitude of the weight of fluid displaced by the body. In an implementation where the buoyancy of the handle body 300 exceeds its weight, it will tend to rise and float. Thus, for example, if the handle body 300 falls into water, it will float rather than sink, making it easier to locate and retrieve.

Referring now to FIG. 9, an exemplary adjustable handle 300 with an adjustable length rope 325 suspending a boat fender 200 from a rod holder of a boat 900 in accordance with principles of the invention is conceptually shown. While a pair of fenders 200 are suspended, any number may be used in connection with an equal number of rod holders or similar devices suitable for supporting a handle body 300.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A boat fender suspender configured for engagement by a conventional rod holder on a boat, said suspender comprising a handle configured for engagement by a rod holder, a tether having a proximal end attached to the handle and distal end adapted for attachment to a boat fender, and said tether having a length to allow the fender to hang from the handle to a desired location alongside a boat, wherein the handle includes an elongated hollow tubular handle body, a compartment within the hollow tubular handle body configured for containing the tether, a first end cap sealing the proximal end of the handle body, a second cap with a central aperture sealing the distal end of handle body, a third cap with an eccentric aperture, said second cap threadedly engaging the third cap, said tether passing through the eccentric aperture and the central aperture.

2. A boat fender suspender according to claim 1, wherein the handle includes an elongated hollow tubular handle body, said hollow tubular handle body comprising a photochromic additive in an amount effective to cause a visible change in color when the hollow tubular handle body reaches a predetermined temperature.

3. A boat fender suspender according to claim 1, wherein the handle includes an elongated hollow tubular handle body, said hollow tubular handle body comprising a thermochromic additive in an amount effective to cause a visible change in color when the hollow tubular handle body reaches a determined temperature.

4. A boat fender suspender according to claim 1, wherein the handle includes an elongated hollow tubular handle body, said hollow tubular handle body comprising a phosphorescent additive in an amount effective to absorb light energy and continue to release that energy as visible light in darkened conditions.

5. A boat fender suspender according to claim 1, wherein the handle includes an elongated buoyant hollow tubular handle body.

* * * * *